US005605015A

United States Patent [19]

Uhl et al.

[11] Patent Number: 5,605,015

[45] Date of Patent: Feb. 25, 1997

[54] TURNSTILE WITH AUTOMATICALLY PIVOTING ARMS

[75] Inventors: Albert Uhl, Karlsruhe; Thomas Birk, Bühl, both of Germany

[73] Assignee: Kaba Gallenschütz GmbH, Bühl, Germany

[21] Appl. No.: 568,942

[22] Filed: Dec. 7, 1995

[30] Foreign Application Priority Data

Dec. 21, 1994 [DE] Germany ..... 44 45 698.0

[51] Int. Cl.[6] ..... E06B 11/08

[52] U.S. Cl. ..... 49/47

[58] Field of Search ..... 49/42, 46, 47, 49/141

[56] References Cited

U.S. PATENT DOCUMENTS

| | | | |
|---|---|---|---|
| 2,019,326 | 10/1935 | Stuart | 49/47 |
| 3,978,613 | 9/1976 | Hayward et al. | 49/47 X |
| 5,072,543 | 12/1991 | Tetherton | 49/47 |
| 5,355,630 | 10/1994 | Kocznar et al. | 45/47 X |
| 5,471,795 | 12/1995 | Gallenschütz et al. | 49/47 X |

FOREIGN PATENT DOCUMENTS

| | | |
|---|---|---|
| 6937378 | 1/1970 | Germany . |
| 2825787 | 12/1979 | Germany . |
| 4036878 | 5/1992 | Germany . |

*Primary Examiner*—Brian K. Green
*Assistant Examiner*—Jerry Redman
*Attorney, Agent, or Firm*—Collard & Roe, P.C.

[57] ABSTRACT

An apparatus including a turnstile for controlling the passage of person including a locking assembly with a bearing dish for rotating about an axis of rotation which is oriented approximately 45° from a horizontal line. A releasable locking device selectively allows and restrains rotational movement of the locking assembly in both directions. At least two locking arms are pivotally mounted to the bearing dish about pivot axis extending transverse to a longitudinal axis of the respective locking arm. Each locking arm is pivotable between a substantially-horizontally locked position and a released position permitting unobstructed passage to the turnstile. A locking bar is provided for each locking arm which arrests the respective locking arm in the locked position. An electromagnet maintains a release device in a pre-cocked position. Upon loss of power, the electromagnet actuates the locking bolt to pivot the locking arm into the release position. When power is restored, the bearing dish is remotely activated which automatically returns the locking arm to its locked position.

6 Claims, 5 Drawing Sheets

TURNSTILE WITH AUTOMATICALLY PIVOTING ARMS

BACKGROUND OF THE INVENTION

1. Field of the Invention

The present invention relates to a turnstile with automatically pivoting arms. More particularly, it relates to a turnstile where the arms are automatically lowered upon power loss and automatically reset upon power restoration.

2. The Prior Art

Turnstiles are used as gateways in order to control the access or exit of pedestrians. The passage through such gateways is controlled by moving the turnstile through steps depending on previously defined criteria, which can be automatically checked. At the same time, uncontrolled and quick passage through such gateways for pedestrians must be assured in selected situations, such as, emergency situations.

Such a turnstile installation is known, for example, from DE-OS 2,825,787. In the event of power failure or if the power is switched-off, an electromagnet is de-activated and a releasing device is no longer maintained in a pre-cocked position. The releasing device slides under spring force to pivot a locking bar supporting the locking arm which becomes disengaged from a bearing tongue connected with the locking arm. Thereafter, the force of gravity acting on the locking arm causes the latter to drop into a folded-down position clearing the passage. To reset the turnstile, the locking arm has to be pivoted by hand into the horizontal position until the bearing tongue is locked again with the locking bar. In addition, the slide has to be moved again into its original operating position by the electromagnet of the releasing device against the spring force acting on the slide.

The prior art turnstile has to be equipped with a powerful electromagnet. Resetting the turnstile by hand following a power loss is quite complicated, especially when large numbers of turnstiles are involved.

SUMMARY OF THE INVENTION

It is therefore an object of the present invention to overcome the drawbacks of the prior art and to provide a remotely controllable turnstile having a simplified structure and reduced energy consumption.

It is a further object of the present invention to provide such a turnstile which automatically returns to the normal operating position following power loss.

These and other related objects are achieved according to the invention by an apparatus including a turnstile for controlling the passage of persons. The apparatus includes a locking assembly including a bearing dish for rotating about an axis of rotation which is oriented approximately 45° from a horizontal line. A releasable locking device selectively allows and restrains rotational movement of the locking assembly in both directions. At least two locking arms are pivotally mounted to the bearing dish about pivot axes extending transverse to a longitudinal axis of the respective locking arm. The locking arms are spaced from each other in a circumferential direction of the locking assembly. Each locking arm includes a bearing body and is pivotable between a locked position and a released position. In the locked position, the locking arm is substantially horizontal to block the passage and successively operable by rotation of the locking assembly about the axis of rotation to allow the passage of persons. In the released position, the locking arm folds down about the pivot axis onto the bearing dish permitting unobstructed passage through the turnstile.

A locking bar is provided for each locking arm which is pivotally mounted on the bearing dish. The locking bars include a double-arm lever with one reset lever and one arrest lever engaging the bearing body. The arrest lever arrests the respective locking arm in a locked position and maintains the locked position by a spring force. A release device is retained in a pre-cocked position against the further spring force by an electromagnet. In the absence of the electromagnet retaining force, the release device actuates the locking bar so that the locking arm is folded down into the released position. The reset lever is operatively pivoted by the bearing body when the locking arm is in the released position to automatically reset the release device upon restoration of the electromagnet retaining force.

Since the locking bars are each provided with a reset arrangement, the release device is returned to its pre-cocked position without additional energy expenditure when the locking arm swings into the folded-down position. The electromagnet therefore provides a holding function exclusively. This means that the electromagnet can be small with a correspondingly lower power consumption.

The bearing body comprises a shaped cam with a locking shoulder. The arrest lever has an end with a molded locking nose which locks against the locking shoulder in the locked position. The locking device comprises a nose-like projection molded onto the reset lever facing the release device. The locking device further comprises an ascending curved region on the double-arm lever facing the bearing body and a concave recess, adjacent the curved region. The concave recess is shaped to accommodate a path formed by the cam upon pivoting of the bearing body. The curved region cooperates with the cam when the locking arm is in the released position. The locking assembly further includes a bearing block for supporting the release device so that the release device is positioned to disengage the locking arm from the locked position.

The release device includes a U-shaped bracket with a top leg and a bottom leg which is mounted on the bearing block. The electromagnet is mounted onto the top leg. Two longitudinally-displaceable guide bars with lower ends extend through the bottom leg. One bar is located on either side of the electromagnet. A release plate is connected to the lower ends of the two guide bars. A metallic holding plate is connected to both guide bars between the electromagnet and the bottom leg. Retaining clips are disposed on the guide bars facing the top leg and supporting the holding plate. A first spring is disposed on each guide bar between the top leg and the retaining clip and a second spring is disposed on each guide bar between the holding plate and the bottom leg. The first spring has a greater spring force than the second spring. The release plate has two ends projecting laterally outwardly past the guide bars forming run-up ramps.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
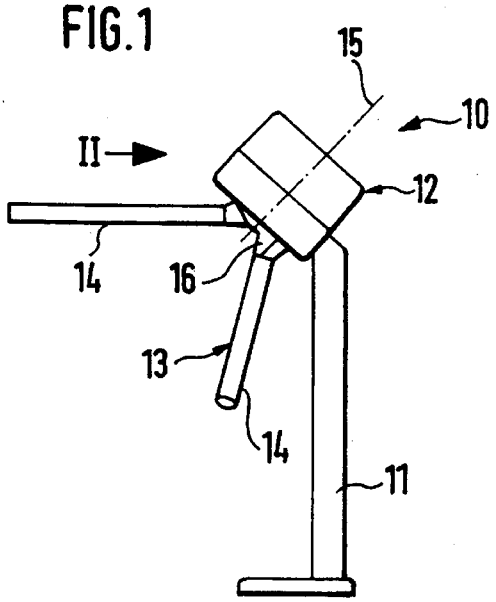
FIG. 1 is a front side elevational view of a turnstile according to the invention with one of the locking arms extending horizontally to block passage through the turnstile.
Figure 2:
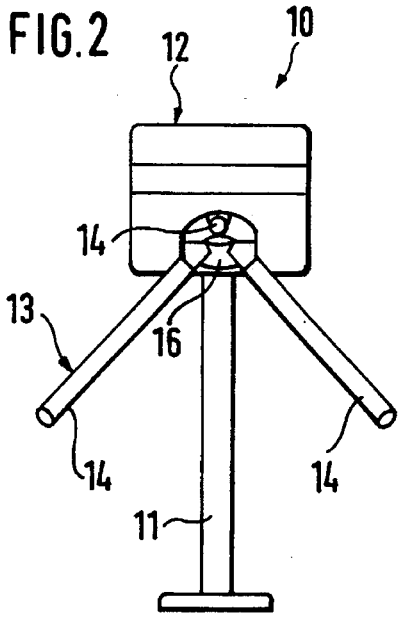
FIG. 2 is a left side elevational view thereof, in the direction of arrow II from FIG. 1.
Figure 5:
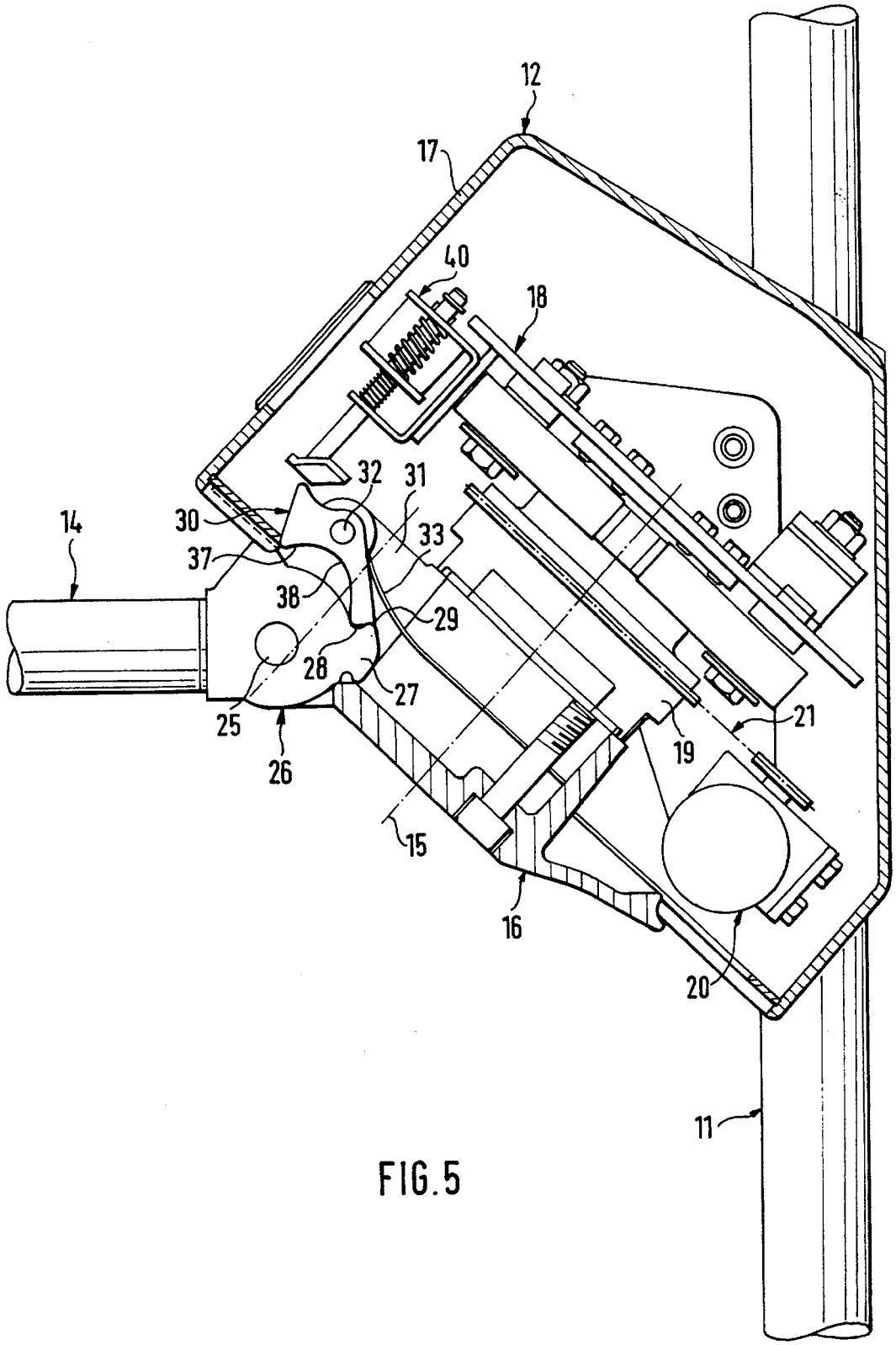
FIG. 5 is an enlarged cross-sectional view showing the locking arm pivotally mounted on a bearing dish.
Figure 6:
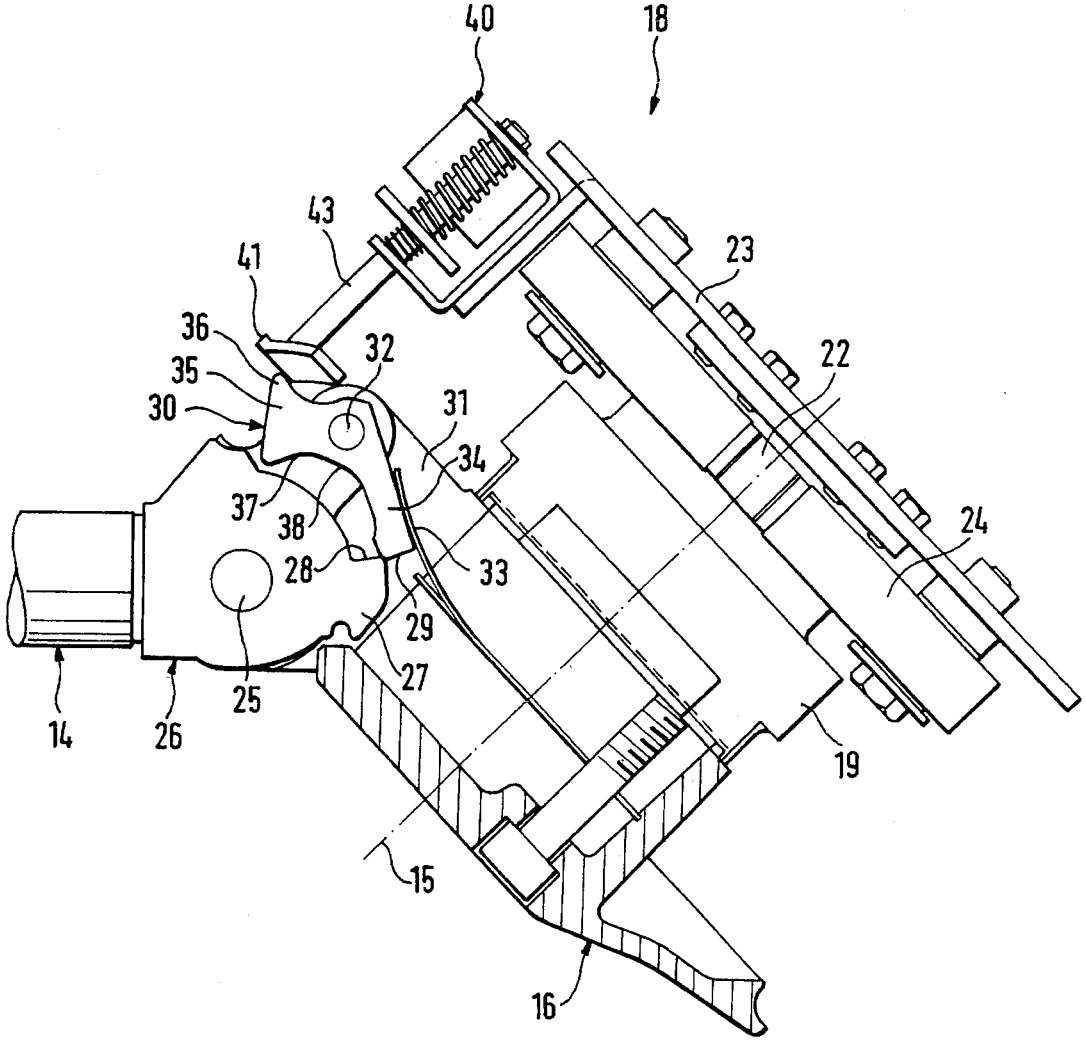
FIG. 6 is a front side elevational view similar to FIG. 5, showing the locking arm prior to folding down out of the locked position.

Referring now in detail to the drawings, and in particular FIGS. 1 and 2, there is shown an apparatus 10 according to the invention which includes a post 11 supporting a driving unit 12 for a turnstile 13. Turnstile 13 has three locking arms 14, which are separated from each other by 120° and which rotate about a rotary axis 15, which is inclined by about 45° versus an imaginary horizontal line. Locking arms 14 can be folded down from their normal operating positions, shown in FIGS. 1 and 2, into positions of non-use, around pivot axes extending at right angles relative to the axis of rotation 15. As can be seen in FIG. 5, the pivot axes comprise bearing pins 25 which are pivotally mounted on a bearing dish or hub 16 of a bearing block or hub support 18 disposed within a housing 17 of the driving unit 12. Bearing dish 16 is torsionally, rigidly connected to a driving shaft 19 which is in direct driving connection with a stepper motor 20 via a chain drive 21o Furthermore, on the side remote from bearing dish 16, driving shaft 19 is torsionally rigidly connected with a cam disk 22 having control cams and pawls 24, as can be seen in FIG. 6. Pawls 24 are pivotally mounted on a bearing plate for cooperating with cam disk 22 in a way that is of no further interest here.

In their normal positions, locking arms 14 extend from bearing dish 16 onto the jacket of an imaginary cone-shaped shell which opens facing away from bearing dish 16. During normal operation, one of the three locking arms 14 is oriented horizontally, i.e., in a locking position projecting into the passage zone, whereas the other two locking arms 14 are pivoted away from the passage into downwardly-pointing, slanted positions, as shown in FIGS. 1 and 2.

When a person wishes to pass through the turnstile, the locking arm 14 present in the locking position is moved due to triggering by such person of stepper motor 20 and due to rotation of bearing dish 16 and turnstile 13, so that passage of the person is allowed. At the same time, the locking arm 14 following in the direction of rotation is rotated into a position blocking the passage zone behind the passing person.

In connection with the turnstile shown, locking arms 14 are separated from each other by 120°. One rotary cycle of turnstile 13 conforms to a 120° rotation, and during normal operation, one locking arm 14 is always in a blocking position across the passage zone. As will be explained in greater detail below, locking arms 14, which are capable of folding down around a pivot axis, are detachably locked in the normal operating positions shown in FIGS. 1 and 2, and are maintained in said locked positions, in a manner which will be explained in greater detail below.

Figure 7:
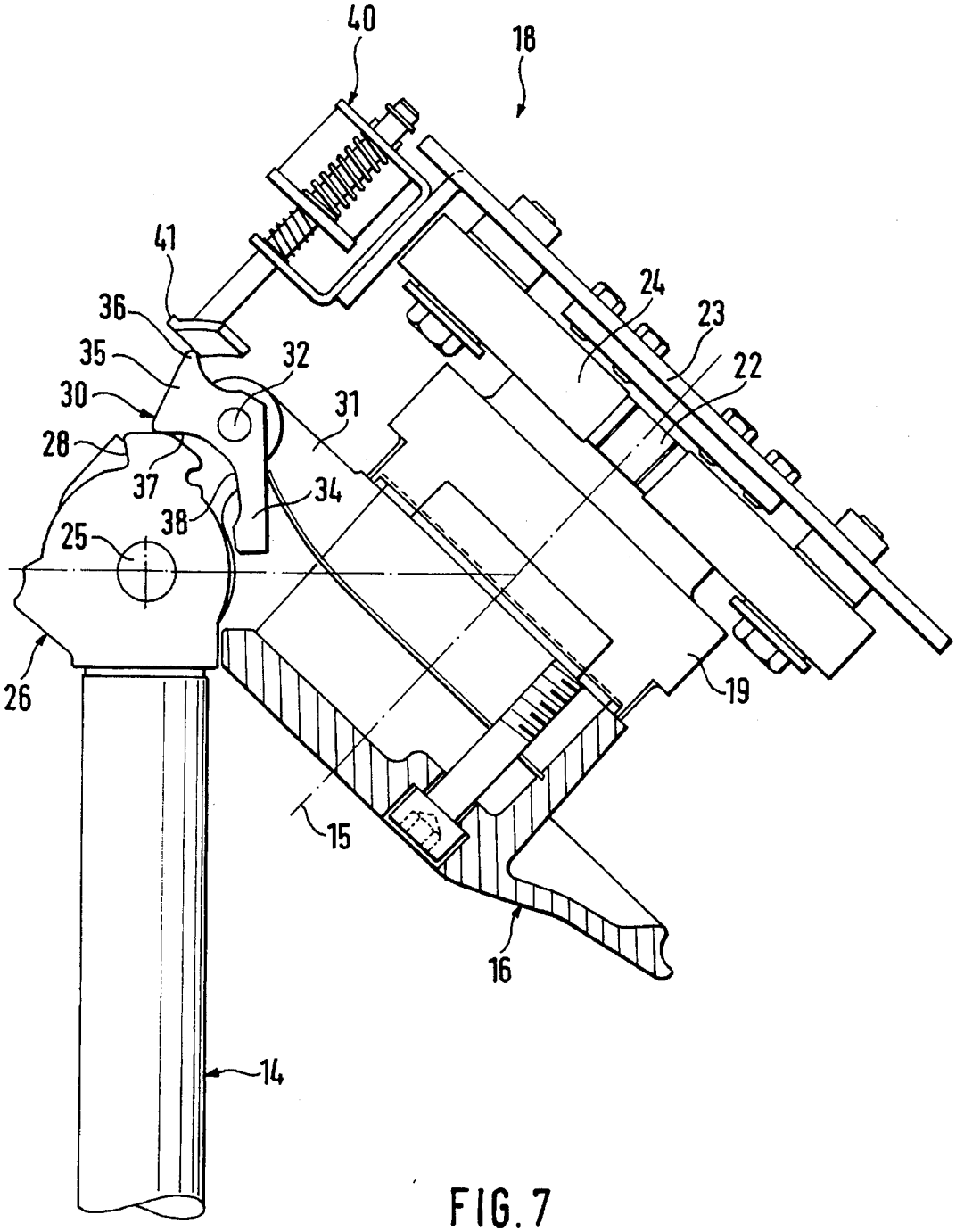
FIG. 7 is a front side elevational view showing the locking arm in the released position.

FIGS, 5 to 7 show the pivotal mounting of locking arm 14 on bearing dish 16 of driving unit 12 with the other locking arms omitted for the sake of clarity. The pivot mount is foldable down from the operating position (FIG. 5) into a position of non-use (FIG. 7). A bearing pin 25 extends at a right angle relative to rotary axis 15 and serves as the pivot mount in each case. Bearing pins 25 are disposed on bearing dish 16 in a way that is of no further interest here. Stepper motor 20, which is only shown schematically, is arranged radially beyond the rotary circle of a rotating bearing console 31 of bearing dish 16.

A bearing body 26, which is rigidly arranged on the end of the each locking arm 14, is pivotably mounted on bearing pin 25. On the side of bearing pin 25 remote from locking arm 14, each bearing body 26 has a radially projecting cam 27 with a locking shoulder 28. In the locked position of the locking arm 14 shown in FIG. 5, locking shoulder 28 is gripped from behind by a locking nose 29 of a locking bar 30. Locking bars 30 are swivel-mounted, in each case against the action of a return spring 33. The swivel mount comprises a bearing pin 32 arranged on the bearing console 31 which extends radially from bearing dish 16. Locking bars 30 pivot parallel to the pivot axis defined by the respective bearing pin 25.

Locking bars 30 are double-arm levers with one lever arm 34 forming locking nose 29 which cooperates with locking shoulder 28 of bearing body 26. The other lever arm 35 in each case has a nose-like projection 36, on a side remote from the bearing pin 25 of the respective locking arm 14, which cooperates with a release device 40, which is described hereinafter. On the side facing bearing body 26 of the associated locking arm 14, locking bars 30 include an ascending curved track 37 arranged within the pivot path of bearing body 26. Adjacent to curved track 37 is a recess 38, which is concave relative to the respective bearing body. Recess 38 is arranged beyond the pivot path of bearing body 26. When a locked arm 14 is folded down from the locked position according to FIG. 5 into the folded-down position according to FIG. 7, the projecting cam 27 of the respective bearing body 26 cooperates with or contacts curved track 37 swinging the respective locking bar 30 back from its release position. This actuates the release device 40 in a way explained further below, bringing the device into a ready-for-operation position.

Figure 9:
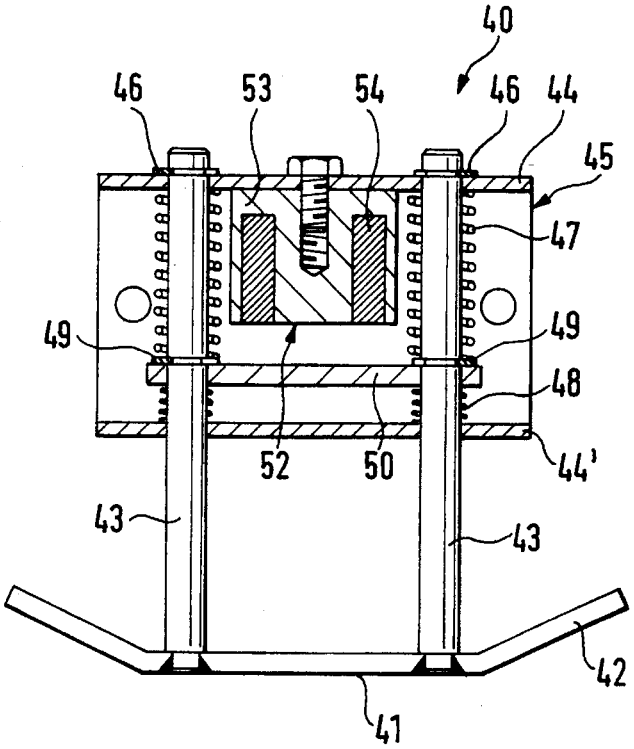
FIG. 9 is a cross-sectional view of the release device taken along the line of IX—IX from FIG. 8.
Figure 8:
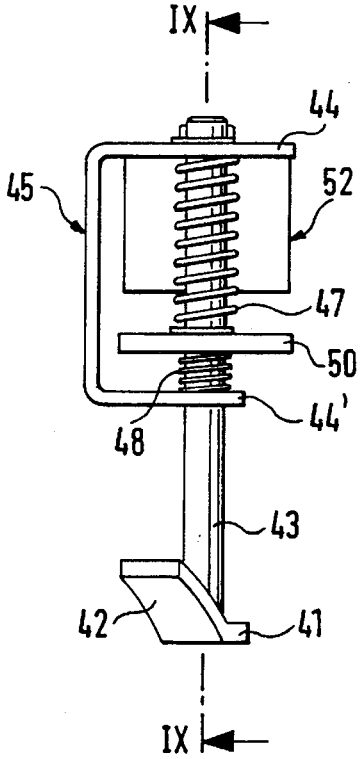
FIG. 8 is front side elevational view of a release device for the locking arm.

Viewed in the circumferential direction, the release device 40 is arranged on bearing plate 23 radially spaced from rotary axis 15. Release device 40 includes a release plate 41, which, on the side remote from the locking arms 14, is disposed above the turning circle formed by projections 36 of lever arms 35 when the bearing dish 16 is revolving. As can be seen in FIGS. 8 and 9, release plate 41 has a curved shape, conforming to such turning circle, and, when viewed in the circumferential direction, is fitted on both ends with run-up ramps 42, and is rigidly connected with the two guide bars 43. Guide bars 43 extend parallel to each other and the axis of rotation 15 of the rotary dish. Guide bars 43 are longitudinally, movably disposed within guide recesses, which are formed within legs 44 and 44' of a U-shaped mounting bracket or console 45 of release device 40. Legs 44 and 44' are spaced from each other.

Top retaining clips 46 are secured to the ends of guide bars 43 which project beyond top leg 44 of bracket 45. Top leg 44 is positioned opposite release plate 41. Two helical springs 47 and 48, which have different spring characteristics, are mounted on guide bars 43 within bracket 45. Springs 47 and 48 are concentrically mounted on the guide bars and the two springs 47 and 48 on each bar 43 are arranged coaxially relative to each other. Springs 47, having the greater spring strength, are supported between leg 44 and a bottom retaining clip 49 axially, rigidly received on the guide bars 43. Springs 48, having the lower spring strength, are supported between bottom leg 44' and a metallic holding plate 50, which is longitudinally, movably disposed on guide bars 43. Second spring 48 biases holding plate 50 against bottom retaining clips 49. Finally, release device 40 comprises an electromagnet 52, having an iron body 53 attached to top leg 44 located opposite release plate 41. Electromagnet 52 has a coil body 54 which faces holding plate 50.

Figure 3:
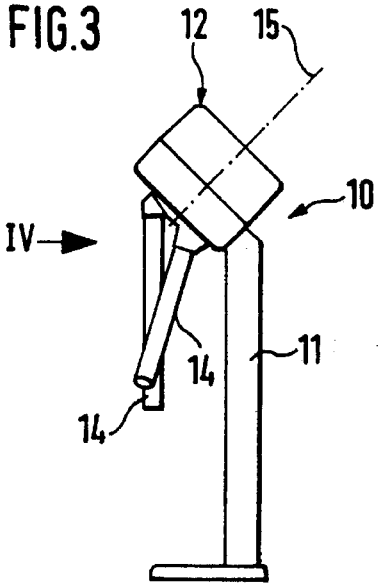
FIG. 3 is a front side elevational view of the turnstile with a locking arm folded down.
Figure 4:
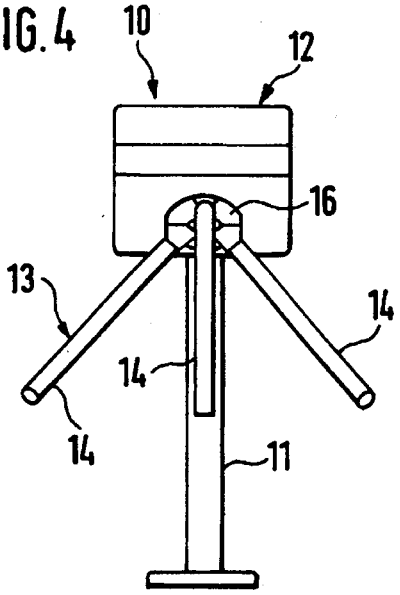
FIG. 4 is a left side elevational view thereof, in the direction of arrow IV from FIG. 3.

In the operating position shown in FIG. 5, voltage is applied to electromagnet 52, which is designed as a holding magnet. Accordingly, holding plate 50 is attracted by coil body 54 and release plate 41 is held in a retracted position against the action of springs 47, which are now pretensioned. In this retracted position, projections 36 of the lever arm 35 pass through an arc below release plate 41 as the turnstile is rotated. However, if the voltage supply to electromagnet 52 is interrupted, either due to an operating defect or power switch-off, the electromagnetic retaining force is canceled. The force contained within pretensioned springs 47 causes release plate 41 to shoot forward, impacting the nose-like projection 36 and swinging locking bar 30 against the action of return spring 33 around its bearing pin 32 into its release position. At the same time, the locking nose 29 is disengaged from the locking shoulder 28 of the bearing body 26 which, until now, has been in the locked position beneath release device 40, as shown in FIG. 6. Following the disengagement of locking nose 29, the locking arm 14, due to force of gravity, swings around its bearing pin 25 into a folded-down position (shown in FIGS. 3, 4 and 7) permitting unobstructed passage through the turnstile.

When a locking arm 14 is folded down from its locking position, the cam 27 projecting radially from the bearing body 26 clears recess 38 before contacting curved track or camming surface 37, and swinging locking bar 30 back in the direction of its locked position. At the same time, projection 36 engages the underside of release plate 41 to actuate release device 40 and bring it into a ready-position. The ready position is defined by holding plate 50, the underside of which is contacted by springs 48, resting against electromagnet 52, shown in FIG. 7. When voltage is applied to electromagnet 52, either after power has been restored following trouble, or due to intended power switch-on, the coil body 54 attracts holding plate 50. Accordingly, the operational condition of release device 40 shown in FIG. 5 is restored.

In the absence of the event triggering the fold-down of locking arm 14, the turnstile is reset to its normal operating condition by stepper motor 20, for example, by remote operation. Turnstile 13 is rotated around rotary axis 15, and locking arm 14, the latter being folded down into its position of non-use, swings back into its normal operating position around its bearing pin 25 under the force of gravity. During such swinging back, cam 27 of the locking arm bearing body 26 slides along recess 38 and, under the action of the return spring 33 engaging lever arm 34, swings the locking bar 30 with its locking nose 29 into engagement with locking shoulder 28, as shown in FIG. 5. In this way, locking arm 14 that was folded down before is now locked in its normal position.

In connection with the turnstile shown in the drawings and explained in the foregoing, which has the three locking arms 14 displaced from each other by 120°, resetting a folded-down locking arm 14 into its normal operating position is achieved in a particularly safe way. In the absence of an event triggering the folding down of a locking arm 14, turnstile 13 is rotated by at least two stepping stages so that the locking arm pivot axis defined by bearing pin 25 on bearing dish 16, passes through the lower point of its orbit. Locking arm 14, which points downwardly in FIG. 7 is inverted so that it points at least partially upwardly. Under the influence of gravity, the free end of locking arm 14 pivots downwardly to return the locking arm to its locked position.

While only a single embodiment of the present invention has been shown and described, it is to be understood that many changes and modifications may be made thereunto without departing from the spirit and scope of the invention as defined in the appended claims.

What is claimed is:

1. An apparatus including a turnstile for controlling a passage of persons comprising:

a hub assembly including a hub support and a hub for rotating about an axis of rotation which is oriented approximately 45° from a horizontal line;

a releasable locking device for selectively allowing and restraining rotational movement of said hub in both directions;

at least two arms pivotally mounted to said hub about pivot axes extending transverse to a longitudinal axis of each said arms, said arms being spaced from each other in a circumferential direction of said hub, each said arms including a bearing body and pivoting between (i) a substantially-horizontal locked position blocking the passage and successively operable by rotation of said hub about the axis of rotation to allow the passage of persons and (ii) a released position in which an arm blocking passage folds down about the pivot axis onto said hub permitting unobstructed passage through the turnstile;

a double-arm lever, for each said arms, pivotally mounted on said hub and comprising one reset lever and one arrest lever engaging said bearing body for arresting one of said arms in said locked position and a first spring for maintaining said double-arm lever in the locked position; and an electromagnet, a second spring and a release device retained in a pre-cocked position against a biasing force of said second spring by said electromagnet, wherein in an absence of an electromagnet retaining force, said release device actuating said double-arm lever so that one of said arms is folded down into the released position, wherein said release device includes;

(i) a U-shaped bracket, with a top leg and a bottom leg, mounted on said hub support with said electromagnet mounted on said top leg;

(ii) two longitudinally-displaceable guide bars with lower ends extending through said bottom leg, one bar being located on either side of said electromagnet;

(iii) a release plate connected to said lower ends of said guide bars;

(iv) a metallic holding plate connected to said guide bars between said electromagnet and said bottom leg;

(v) retaining clips disposed on said guide bars facing said top leg and supporting said holding plate; and (vi) a third spring disposed on each guide bar between said top leg and said retaining clip and a fourth spring disposed on each guide bar between said holding plate and said bottom leg;

said release device being mounted on said hub support and positioned to disengage one of said arms from the locked position;

wherein said reset lever is operatively pivoted by said bearing body as one of said arms folds into the released position, to automatically reset said release device upon restoration of the electromagnet retaining force.

2. The apparatus to claim 1, wherein said third spring has a greater spring force than said fourth spring.

3. The apparatus according to claim 1 wherein said release plate has two ends projecting laterally outwardly past said guide bars forming run-up ramps.

4. A turnstile for controlling a passage of persons comprising:

a hub support, a hub coupled to said hub support for rotation about an axis oriented approximately 45° from a horizontal line, and means for selectively allowing and restraining rotational movement of said hub in both directions;

at least two arms pivotally mounted to said hub and spaced from each other in a circumferential direction of said hub, each arm including a locking shoulder and a cam and pivoting between a locked position blocking passage and a released position in which one of the arms folds down onto said hub permitting unobstructed passage through the turnstile;

a double-arm lever, for each said arms, pivotally mounted on said hub, and including one reset lever, a camming surface and one arrest lever engaging said locking shoulder for arresting one of said arms in said locked position;

an electromagnet and a spring-loaded release device retained in a pre-cocked position by said electromagnet, said electromagnet and said release device being mounted on said hub support wherein in an absence of an electromagnet retaining force, said release device contacts said double-arm lever so that one of said arms is released from the locked position;

wherein as one of said arms folds into the released position, said cam engages said camming surface to pivot said reset lever to slide said release device back into the pre-cocked position where said release device is again retained by said electromagnet upon restoration of the electromagnet retaining force.

5. The apparatus according to claim 4, wherein said arrest lever has an end with a molded locking nose which locks against said locking shoulder in the locked position.

6. The apparatus according to claim 5, wherein said double-arm lever comprises (i) a nose-like projection molded onto said reset lever facing said release device, (ii) an ascending curved region defining said camming surface which faces each of the arms, and (iii) a concave recess, adjacent said curved region, shaped to accommodate a path formed by said cam upon pivoting of one of said arms, wherein said curved region cooperates with said cam as one of said arms pivots into said released position.

* * * * *